US008528131B2

(12) United States Patent
Sun

(10) Patent No.: US 8,528,131 B2
(45) Date of Patent: Sep. 10, 2013

(54) FOLDING COT

(75) Inventor: Se Kyu Sun, Chittagong (BD)

(73) Assignee: HKD Group Limited, North Point (HK)

( * ) Notice: Subject to any disclaimer, the term of this patent is extended or adjusted under 35 U.S.C. 154(b) by 1 day.

(21) Appl. No.: 12/843,554

(22) Filed: Jul. 26, 2010

(65) Prior Publication Data

US 2011/0023232 A1 Feb. 3, 2011

Related U.S. Application Data

(60) Provisional application No. 61/228,181, filed on Jul. 24, 2009.

(51) Int. Cl.

| | |
|---|---|
| ***A47C 19/12*** | (2006.01) |
| ***A47C 19/14*** | (2006.01) |
| ***A47C 17/64*** | (2006.01) |

(52) U.S. Cl.
USPC ..... 5/111; 5/114; 5/115; 5/116; 5/117

(58) Field of Classification Search
USPC ..... 5/111, 110, 114–117, 112, 625, 627
See application file for complete search history.

(56) References Cited

U.S. PATENT DOCUMENTS

| | | | | |
|---|---|---|---|---|
| 952,214 | A * | 3/1910 | Rasmussen | 5/117 |
| 1,096,097 | A * | 5/1914 | Calmes | 5/114 |
| 1,409,380 | A * | 3/1922 | Irwin et al. | 5/114 |
| 1,696,245 | A * | 12/1928 | Manly | 5/314.1 |
| 1,787,566 | A * | 1/1931 | Brown | 5/314.1 |
| 1,806,358 | A * | 5/1931 | Manly | 5/117 |
| 2,128,018 | A * | 8/1938 | Skidmore | 5/114 |
| 2,254,939 | A * | 9/1941 | Elias | 5/114 |
| 2,591,551 | A * | 4/1952 | Kaplan | 5/110 |
| 2,617,999 | A * | 11/1952 | Mitchell | 5/99.1 |
| 5,429,413 | A * | 7/1995 | Levy et al. | 297/45 |
| 8,091,160 | B2 * | 1/2012 | Jin | 5/176.1 |
| 2006/0174415 | A1 * | 8/2006 | Moulton | 5/655 |
| 2010/0235989 | A1 * | 9/2010 | Jin | 5/174 |
| 2011/0023232 | A1 * | 2/2011 | Sun | 5/111 |

* cited by examiner

*Primary Examiner* — Robert G Santos
(74) *Attorney, Agent, or Firm* — Polster, Lieder, Woodruff & Lucchesi, L.C.

(57) ABSTRACT

An improved sleeping or camping cot construction is provided in which the end rails of the cot frame are pivotally mounted along their center along a channel member so that downward forces on the cot in its normal operating position improves the stability of the cot by forcing the end rails into engagement with the channel member. The channel member also encloses the pivot points of the end rails from inadvertent contact a user during the pivot operation of the end rails.

1 Claim, 4 Drawing Sheets

FOLDING COT

CROSS-REFERENCE TO RELATED APPLICATIONS

This application claims priority to U.S. provisional Application Ser. No. 61/228,181 filed Jul. 24, 2009, the specification of which is incorporated herein by reference.

STATEMENT REGARDING FEDERALLY SPONSORED RESEARCH

Not Applicable.

BACKGROUND OF THE INVENTION

This invention relates to camping equipment and more particularly, to cots which may be disassembled into a small lightweight package. While the invention is described in particular detail with respect to use in a camping environment, those skilled in the art will recognize the wider applicability of the inventive principles disclosed hereinafter.

The statements in this section merely provide background information related to the present disclosure and may not constitute prior art.

Portable cots have been known for many years. The typical light weight camp cot includes a rectangular body or frame supporting a sheet; the body typically including a pair of long opposed side rails and a pair of opposed end rails which together the side rails support the sheet.

There are prior art constructions that have been developed in an attempt to fashion a low-cost cot design which will support the user properly, and yet can be disassembled and carried in a compact package between cot setups. Conventionally, the side rails of the cot are formed in two pieces, which are disassembled or folded for transporting the cot. In prior some prior art designs, the end rails themselves were detachable from the side rails for a similar purpose.

Because a certain portions of the supporting frame were detachable from others, it was not unusual for the end user to lose or misplace portions of the supporting frame over time, making the cot nonfunctional. The removal of the end rails each time the cot is folded and their replacement when the cot is extended constitutes an objectionable operation even if the end rails are available. One solution to the problem presented when portions of the cot are detachable from other members of the cot structure is address in co pending Application Number PCT/US2009/050130 assigned to the assignee of the present disclosure, the specification of which is incorporated herein by reference. While various aspects of that Application works well for its intended purpose, the construction and design of the cot provides a somewhat more difficult procedure for assembling and disassembling the cot described hereinafter, particularly when only one person is available to assemble the cot for use and latter disassemble or fold the cot for transportation or storage.

There are cots which have end rails comprising sections centrally hinged for folding movement. The present disclosure utilizes an improved hinge construction which is simple to manufacture and utilize with a simplified attachment to the end rails of the cot construction. The central hinge of the present disclosure is designed so that the weight of a use of the cot exerts forces which act to improve the stability of the frame structure, a result not seen in prior art devices.

The embodiment disclosed hereinafter provides a simple mechanism for cot set up, while maintaining the end rails connected to other frame members, so that the end rails cannot be misplaced, while the entire structure of the cot is still foldable into a compact package for transportation.

BRIEF SUMMARY OF THE INVENTION

In accordance with this disclosure, generally stated, a portable, collapsible cot construction is provided with a frame which provides a foldable cot for a user and enables the structural components forming the cot frame to remain attached in a manner enabling the frame to be compacted into a relatively small bundle. In the preferred embodiment, the frame includes side rails and end rails, the end rails being interconnected with the side rails along their respective ends, while both the side rails and end rails are foldable against one another so that the cot may be compacted with the associated supporting leg assemblies, end rails and side rails enclosed and protected by the fabric of the body support sheet and to be rolled up as a compact bundle of relatively small diameter having a length approximately half the length of the cot in its un-collapsed body supporting condition.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
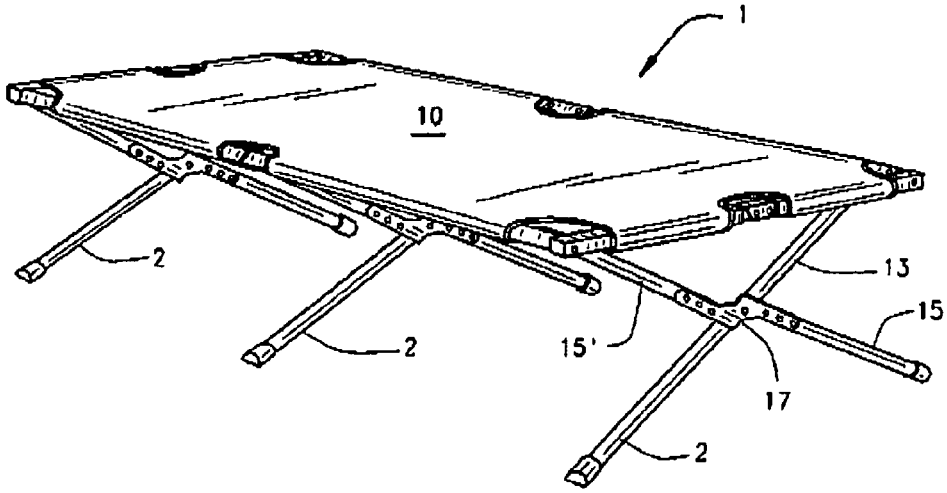
FIG. 1 is a view in perspective of one illustrative embodiment of cot construction of the present invention, shown in its normal body supporting position.

Referring now to FIG. 1, reference numeral 1 indicates one illustrative embodiment of the cot of the present invention. The cot 1 includes a plurality of support struts 2 which in turn are interconnected to respective ones of a pair of side rails 4 and 5 respectively. The side rails 4 and 5 in turn are closed by a pair of end rails 6 and 7 respectively. Finally, a bed sheet 10 extends along and is supported by respective ones of the end rails 6, 7 and side rails 4, 5 of the cot 1.

Figure 4:
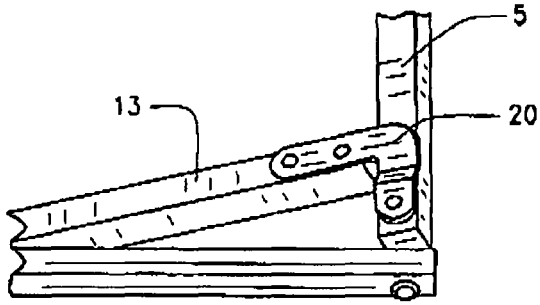
FIG. 4 is a view in perspective, partly broken away, taken about the line 4-4 of FIG. 2.

Each support strut 2 includes a one piece member 13 and a split member 15 and 15'. The members 13, 15 and 15' are interconnected to one another by a z-shaped bracket 17. The bracket 17 permits the split members 15 and 15' prime to close toward one another in the storage position of the cot 1, for example. As will be appreciated by those skilled in the art, the length of the various members can be altered or changed in order to vary the height of the cot 1 from a supporting floor or ground position. The member 13 and the split member 15' each also are attached to the respective side rail 4 or 5 by an L-shaped bracket 20 (FIG. 4) which is pivotally attached to the respective side rails at a pivot point 21, permitting the support struts 2 to be rotated against the respective side rails in the stored or carried position of the cot 1.

While the number of struts 2 used for support of the cot 1 may vary in other embodiments of the invention, a three strut arrangement works well for the embodiment of FIG. 1. As will be appreciated by those skilled in the art, the construction arrangement of the struts 2 preferably are the same for each of the struts 2 employed with the cot 1, the intention being to permit the cot 1 to be folded simply into a relatively light weight carry package for use by campers or others who might require easy set of a sleeping accommodations. One of the features of the side rails 4, 5 and strut 2 construction is that the more weight placed on bed sheet 10, for example, the more the weight acts to maintain the cot 1 in an unfolded or extended position, thereby added to the stability of the cot 1 in application use.

Figure 2:
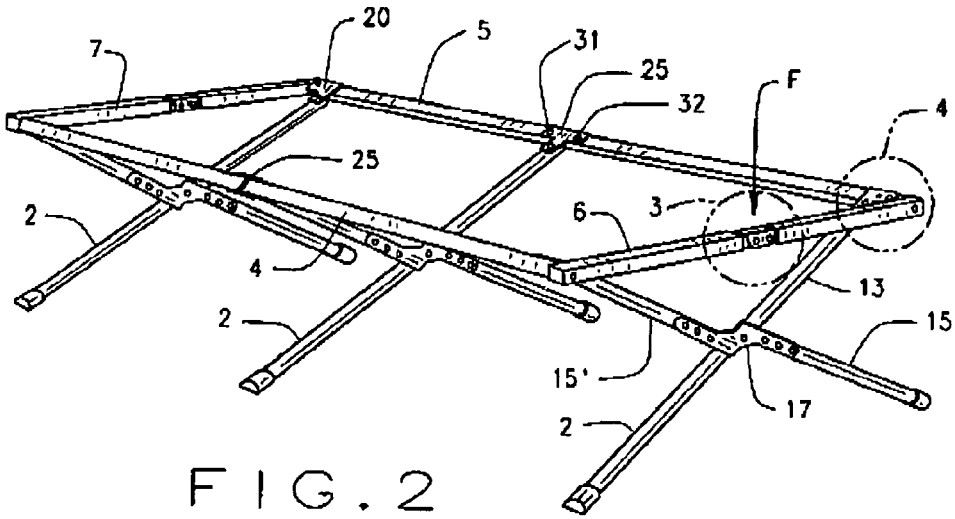
FIG. 2 is a view in perspective illustrating the frame construction of the cot shown in FIG. 1.

As shown in the FIG. 2, the side rails 4 and 5 in turn are rotatably mounted with respect to one another along a bracket 25 which in the preferred embodiment also is arranged to mount one of the struts 2. That is to say, each of the side rails 4 and 5 may be rotated toward itself other along the bracket 25, which preferably bisects each of the side rails 4, 5 in the embodiment of FIG. 1. Each of the side rails 4, 5 and the bracket 25 is attached to the respective sections of the end rails along pivot points 31 and 32. Conventional fasteners may be used to provide a pivoting motion, but those skilled in the art will recognize that other techniques will be employed if desired.

Figure 3:
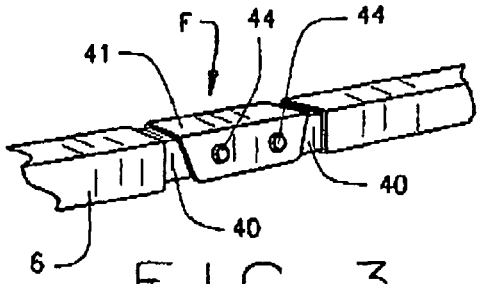
FIG. 3 is a view in perspective, partly broken away, taken about the line 3-3 of FIG. 2.
Figure 3A:
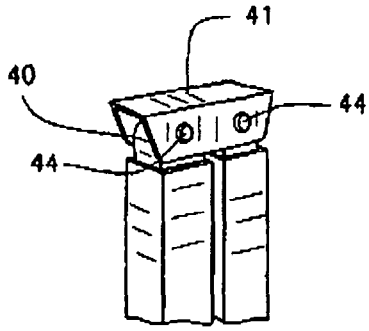
FIG. 3A is a view in perspective, partly broken away, of the folded position of one illustrative and rail.

Revering now to FIG. 3, the end rails 6 and 7 are of two piece construction, having a reduced size part 40 along the central part or the respective end rails 6 and 7. The part 40 is sized for reception in a generally U-shaped channel 41. Other channel shapes may be used if desired. From an esthetic standpoint, it is preferable that the channel 41 generally be level with the end rails in the deployed condition of the cot 1. In addition, from a safety standpoint, it is important that the pivot point of the end rails be enclosed by the channel 41 to prevent inadvertent injury to the hand or fingers of the user when the cot 1 is either set up or taken down for storage. The parts 40 are pivotally attached to the channel 41 along pivots 44. This construction greatly increases the stability of the cot in applicational use. First, a downward force F, referenced to FIG. 3, exerted for example by someone using the cot for its intended purpose, locks or prevents movement of the end rails because of the interaction of the channel 41 and the parts 40 of the end rails. Second, the force F also is transmitted by the end rails to the bracket 17, which further locks the member with respect to the bracket 17.

As will appreciated by those skilled in the art, the bed sheet 10 maybe made adjustable by using a bed sheet construction similar to that described and shown in Provisional Application No. 61/079,714 filed Jul. 10, 2008 incorporated herein by reference.

Figure 5:
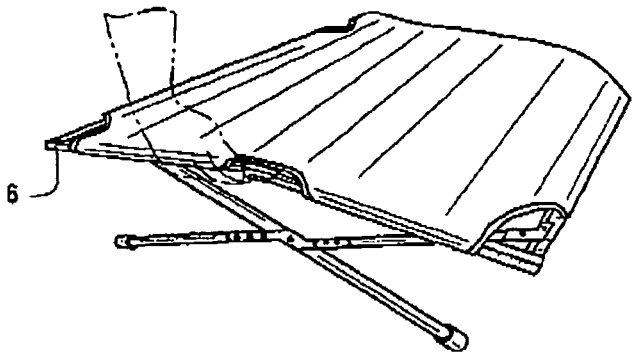
FIGS. 5 and 5A-E are views in perspective of the cot embodiment shown in FIG. 1 showing the folding sequence of the cot shown in FIG. 1.
Figure 5A:
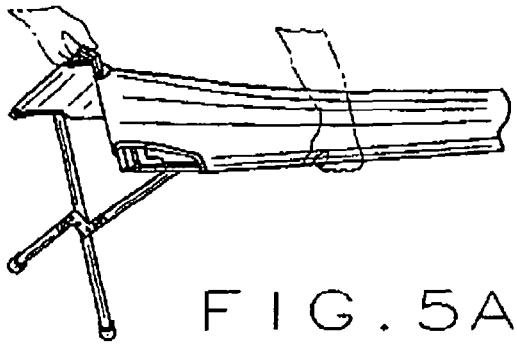
Figure 5B:
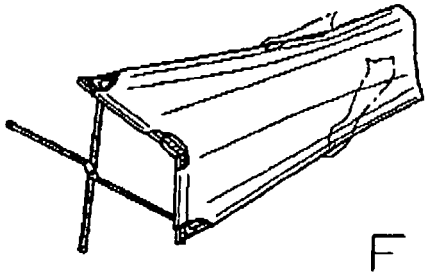
Figure 5C:
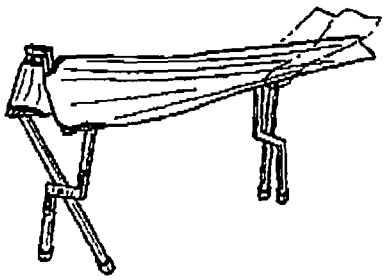
Figure 5D:
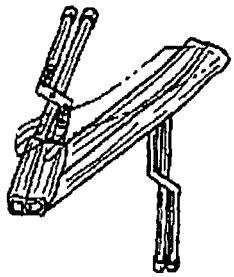
Figure 5E:
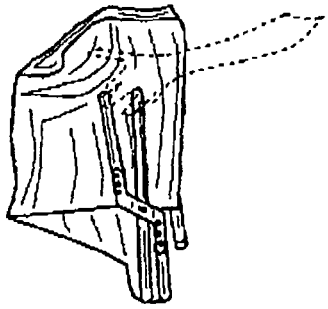

The operation of the cot 1 is shown in FIG. 5. As there shown, the initially one of the end rails 6 and 7 are raised upwardly as shown in FIG. 5*a*. As the respective end rail is raised upwardly, the associated support strut 2 collapses until the members 13, 15 and 15' meet one another. The side rails 4 and 5 are collapsed toward one another as show in FIG. 5 C. One end of the cot 1 the is rotated as shown in FIG. 5 D to meet he side rails 4, 5. Then the end rails are rotated into position against the side rails (FIG. 5 D) and the side rails and one section of the side rails are pivoted toward the center strut 2 as shown in FIG. 5 E. The step just described are repeated for the other end rail of the cot. In each step, the cot 1 remains relatively stable to enable a single user to either compact the cot after use or deploy the cot for use.

The bed sheet 10 can be used to hold the entire cot structure in relatively compact form, and a carrying case, not shown, preferably is provided to carry the cot between intended uses.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense. Merely by way of example, other pivoting and/or rotating arrangement for the end rails and their relationship to the side rails will occur to those skilled in the art. As indicated, the dimensions of the cot 1 may be varied. Likewise, other structural forms for use as tensioning devices will occur to those skilled in the art in view of the present disclosure. These variations are merely illustrative.

The invention claimed is:

1. A cot having a frame for supporting a bed sheet, the frame comprising:

a pair of opposed side rails, each of said opposed side rails including first and second parts pivotally interconnected to one another;

a pair of opposed end rails; each of said end rails having a first segment and a second segment, each of the segments having a first end and a second end, one end of each segment being pivotally attached to respective ones of said side rails;

a channel member adapted to receive and pivotally mount a second end of each end rail segment to close the frame in the bed sheet supporting position of the frame, the second end of each end rail segment having at least one reduced dimension as compared to the first end of each end rail segment, the channel member being pivotally mounted to the second end of each end rail segment to permit vertical upward movement of said end rail segments, the pivot point of the second end of each end rail segment being internal to the channel member such that a downward force on the end rails in the bed sheet supporting position the cot forces further engagement of the second end of each end rail segment with the channel member; and at least a pair of foldable cot supports attached to at least one of said side rails and said end rails, said cot supports fold inwardly as the end rail segments move vertically upwardly so that the vertical upward movement of the end rail segments causes at least one of the pair of foldable cot supports to fold inwardly to initiate a cot folding procedure.

* * * * *